United States Patent [19]

Clarke

[11] 3,995,861

[45] Dec. 7, 1976

[54] DART FLIGHTS

[75] Inventor: Robert L. Clarke, Stansted, England

[73] Assignee: Clarke & Merrifield Limited, England

[22] Filed: July 18, 1975

[21] Appl. No.: 597,287

[52] U.S. Cl. ..... 273/106.5 C; 273/106.5 R

[51] Int. Cl.[2] ..... A63B 65/02

[58] Field of Search ..... 273/106.5 R, 106.5 C, 273/106 A

[56] References Cited

UNITED STATES PATENTS

| | | | |
|---|---|---|---|
| 2,887,319 | 5/1959 | Lay | 273/106.5 C |

FOREIGN PATENTS OR APPLICATIONS

| | | | |
|---|---|---|---|
| 1,239,629 | 7/1960 | France | 273/106.5 R |
| 1,035,547 | 7/1958 | Germany | 273/106 A |
| 145,161 | 5/1954 | Sweden | 273/106 A |
| 531,326 | 1/1941 | United Kingdom | 273/106.5 R |
| 353,638 | 7/1931 | United Kingdom | 273/106.5 C |
| 599,242 | 3/1948 | United Kingdom | 273/106.5 R |
| 479,525 | 2/1938 | United Kingdom | 273/106.5 R |
| 506,176 | 5/1939 | United Kingdom | 273/106.5 R |
| 664,850 | 1/1952 | United Kingdom | 273/106.5 C |
| 679,970 | 9/1952 | United Kingdom | 273/106.5 R |
| 584,993 | 1/1947 | United Kingdom | 273/106.5 R |
| 717,353 | 10/1954 | United Kingdom | 273/106.5 C |

*Primary Examiner*—Paul E. Shapiro
*Attorney, Agent, or Firm*—Brisebois & Kruger

[57] ABSTRACT

A dart having a detachable flight assembly, comprises an elongate metal body having a needle extending axially forwards from the body and a spigot extending axially rearwards from the body, and a flight assembly including at least three flight blades arranged around and attached to a stem, the stem terminating in an adaptor made from a thermoplastics material and including a socket which is adapted to be a push fit on to the spigot, so that the flight assembly is held in frictional inter-engagement with the body. The spigot and socket may each include a corresponding taper. The adaption of the flight assembly may be made from a resilient thermoplastics material and in this case, a co-operating locking projection and recess are formed on the surfaces of the spigot and socket, so that when the socket of the flight assembly is pushed on to the spigot on the body, the locking projection snaps into engagement with the corresponding recess to interlock the flight assembly and the body.

1 Claim, 5 Drawing Figures

DART FLIGHTS

This invention relates to darts of the type having a detachable flight assembly which is replaceable if it is damaged.

In the past such flight assemblies have included a stem having a male screw-thread at one end which screws into a co-operating female screw-threaded bore provided in the body of the dart. Thus a screw connection is made between the two parts of the dart to hold the flight assembly on to the body.

According to this invention a dart having a detachable flight assembly, comprises an elongate metal body having a needle extending axially forwards from the body and a spigot extending axially rearwards from the body, and a flight assembly including at least three flight blades arranged around and attached to a stem, the stem terminating in an adaptor made from a thermoplastics material and including a socket which is adapted to be a push-fit on to the spigot, so that the flight assembly is held in frictional inter-engagement with the body.

Rather surprisingly we have found that a simple spigot and socket joint provides a sufficiently rigid joint between the body and the flight assembly of a dart and such a joint facilitates manufacture, particularly on a mass production scale, and also facilitates the replacement of a damaged flight assembly.

The spigot which extends rearwardly from the body of the dart may be tapered and the socket in the adaptor may be correspondingly tapered. In this case the adaptor may be made from a substantially rigid thermoplastics material.

Preferably, the adaptor of the flight assembly is made from a resilient thermoplastics material and a co-operating locking projection and recess are formed on the surfaces of the spigot and socket, so that when the socket and flight assembly is pushed on to the spigot on the body the locking projection snaps into engagement with the corresponding recess to interlock the flight assembly and the body.

Preferably the locking projection extends radially inwards from the internal wall of the socket and there is a corresponding recess extending radially inwards into the side wall of the spigot. The locking projection is preferably arranged in the form of an annular rib around the internal face of the socket adjacent its open end and a corresponding annular groove is formed in the side wall of the spigot.

According to another aspect of our invention, a dart flight assembly comprises at least three flight blades arranged around and attached to a stem, the stem terminating in an adaptor made from a thermoplastics material and including a tapering socket which is arranged to co-operate with a tapering spigot extending rearwards from the body of the dart.

According to a further aspect of our invention, a dart flight assembly comprises at least three flight blades arranged around and attached to a stem, the stem terminating in an adaptor made from a resilient thermoplastics material and including a socket, means being provided in the socket adjacent its open end to interlock the dart flight assembly with a spigot extending from the body of a dart.

The adaptor of the dart flight assembly is preferably made from polypropylene when it is required that the adaptor is made from a resilient thermoplastics material as this material has a very good elastic memory and so, after distortion, readily springs back to its undistorted shape. The flight blades may be formed by folding from a single sheet of plastics material so that each blade is formed by two thicknesses of the material folded back to back, there being three or four separate equiangularly spaced blades.

The adaptor and the stem of a dart flight assembly may be made integrally and, in this case the flight blades may be received in slots formed in the end of the stem remote from the adaptor. Alternatively, the adaptor and the stem are formed separately and then fixed together, the adaptor being mounted on one end of the stem and the flight blades being mounted on the other end remote from the adaptor. The stem may be made from metal, cane, bamboo, or a rod made from glass fibre reinforced plastics, but preferably it is made from one or more thin metal pins as described in our co-pending U.S. patent application Ser. No. 597,288, filed July 18, 1975.

This application discloses a flight assembly which includes an adaptor and at least three flight blades prepared by folding from a sheet of plastics material, the blades being directly mounted on one or more thin metal pins so that they are not rotatable with respect to the pin or pins. The application also discloses a flight assembly including the same number of pins as there are flight blades, the pins being held in the adaptor at one end and being substantially parallel to each other, each pin being in tangential contact with its adjacent pins over at least part of its length, the flight blades being slid between the pins so that they are prevented from rotating with respect to the pins.

A dart in accordance with this invention together with modifications of a dart flight also in accordance with this invention will now be described with reference to the accompanying drawings, in which.

Figure 1:
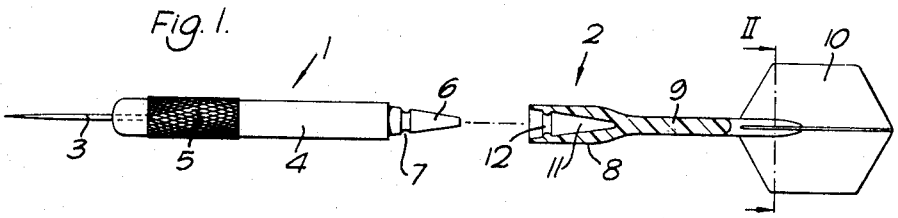
FIG. 1 is an exploded partly sectioned side elevation of a dart.
Figure 2:
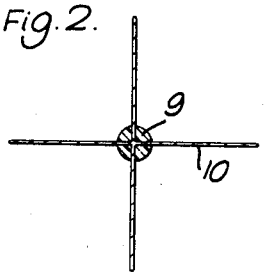
FIG. 2 is a cross-section taken along the lines 2—2 of FIG. 1.

The dart comprises a body 1 and a flight assembly 2. A needle 3 made from hardened and tempered steel is fixed to a barrel 4 of the dart body. The barrel of the dart body is made from brass but it may be made from tungsten. The barrel 4 of the dart body includes a knurled finger grip 5. A tapering spigot 6 projects from the rear end of the dart body and the tapering spigot 6 includes an annular groove 7. The dart flight assembly 2 includes an integrally moulded adaptor portion 8 and stem 9 made from polypropylene material. The end of the stem 9 remote from the adaptor portion 8 includes a cruciform slot and four flight blades 10 prepared by folding from a sheet of polyester material. The cruciform slot is shown in more detail in FIG. 2. The adaptor portion 8 includes a tapering socket 11 having a taper corresponding to that of spigot 6 and an inwardly projecting annular rib 12.

Figure 3:
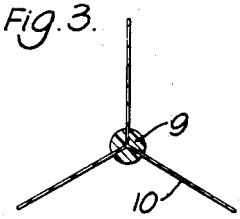
FIG. 3 is a cross-section similar to FIG. 2 taken through a modification of the dart flight assembly.

When the socket 11 of the flight assembly 2 is pushed on to the spigot 6 of the body 1 of the dart, the annular rib 12 snaps into engagement with the annular groove 7 and positively engages the flight assembly 2 with the dart body 1. A modification of the dart flight assembly 12 is shown in FIG. 3. The dart flight assembly in this modification also includes an integrally moulded adaptor and stem but in this modification the stem includes a generally Y-shaped slot and three flight blades, again folded from a sheet of polyester material, which are inserted into the Y-shaped slot in the end of the stem.

Figure 4:
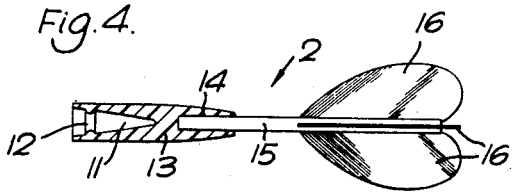
FIG. 4 is a partly sectioned side elevation of another modification of a dart flight assembly; and, FIG. 5 is a partly sectioned side elevation of a further modification of a dart flight assembly.

In the modification of the flight assembly 2, shown in FIG. 4, an adaptor 13 moulded from polypropylene material not only includes a socket 11 with an annular rib 12 but also includes a parallel-sided socket 14. A stem 15 of cane is pushed into the socket 14 and may be adhered to the socket 14. The stem 15 may also be made from a rod of glass fibre reinforced plastics material or by a metal rod such as aluminium. Four flight blades 16 made from natural feathers are glued on to the stem 15 to complete the dart flight assembly.

Figure 5:
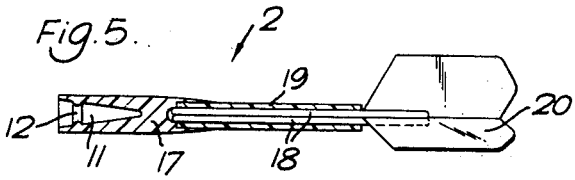

The further modification of a dart flight assembly shown in FIG. 5 includes an adaptor 17 again made from polypropylene material and once again including a tapering socket 11 having an upstanding annular rib 12 adjacent its open end. Three twenty-gauge spring steel pins 18 are pushed into a parallel sided bore in the adaptor 17 and are arranged parallel to each other and in tangential contact with each other. A piece of plastics sleeving 19 is threaded over the three pins 18 and a set of three-bladed flight blades are slid between the free ends of the three pins 18. The set of flight blades 20 are prepared by folding from a sheet of polyester material and, in a similar fashion to the flight blades 10 they may be prepared by a method in accordance with our co-pending U.S. patent application Ser. No. 567,803, filed April 14, 1975.

I claim:

1. A dart flight assembly comprising at least three pins, said at least three pins being formed from spring steel, an adaptor portion, means mounting one end of said at least three pins in said adaptor portion, said adaptor portion being made from polypropylene and including a tapering socket, an annular rib extending inwards adjacent the open end of said socket, at least three flight blades formed by folding from polyester sheet material, said at least three flight blades being held between said at least three pins whereby said flight blades are prevented from rotating with respect to said pins, and a sleeving of plastics material sheathing said at least three pins between said adaptor portion and said at least three flight blades.

* * * * *